US007163174B2

(12) United States Patent
Lieber

(10) Patent No.: US 7,163,174 B2
(45) Date of Patent: Jan. 16, 2007

(54) METHOD AND APPARATUS FOR WINDING A YARN PACKAGE

(75) Inventor: Reinhard Lieber, Sprockhövel (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 953 days.

(21) Appl. No.: 09/952,349

(22) Filed: Sep. 13, 2001

(65) Prior Publication Data

US 2002/0033428 A1 Mar. 21, 2002

Related U.S. Application Data

(63) Continuation of application No. PCT/EP01/00104, filed on Jan. 8, 2001.

(30) Foreign Application Priority Data

Jan. 13, 2000 (DE) ..... 100 01 085

(51) Int. Cl.
*B65H 54/32* (2006.01)
*B65H 54/38* (2006.01)

(52) U.S. Cl. ..... 242/477.2; 242/477.3; 242/481.4

(58) Field of Classification Search ..... 242/477.2, 242/477.3, 481.4
See application file for complete search history.

(56) References Cited

U.S. PATENT DOCUMENTS 4,325,517 A * 4/1982 Schippers et al. ..... 242/477.2
4,498,637 A * 2/1985 Yamamoto et al. ..... 242/477.2
4,544,113 A 10/1985 Yoshinaga et al.
4,659,027 A * 4/1987 Schippers et al. ..... 242/477.5
4,767,071 A 8/1988 Hirai
4,771,960 A 9/1988 Yamamoto et al.
4,913,363 A 4/1990 Lenz
5,112,001 A * 5/1992 Yamamoto et al. ..... 242/477.2
5,275,343 A * 1/1994 Yamamoto et al. ..... 242/480.5
5,954,289 A 9/1999 Hermanns et al.
6,065,712 A * 5/2000 Mayer et al. ..... 242/477.2
6,186,435 B1 * 2/2001 Mayer et al. ..... 242/477.2
6,283,401 B1 * 9/2001 Lieber et al. ..... 242/477.2
6,308,907 B1 * 10/2001 Bartkowiak ..... 242/477.2

FOREIGN PATENT DOCUMENTS

DE 3825413 A1 2/1990
DE 4310905 A1 10/1994
DE 19625511 A1 1/1998
EP 0235557 B1 9/1987
WO WO 99/48786 A1 9/1999

* cited by examiner

*Primary Examiner*—Kathy Matecki
*Assistant Examiner*—Scott Haugland
(74) *Attorney, Agent, or Firm*—Alston & Bird LLP

(57) ABSTRACT

A method and an apparatus for winding a yarn package, wherein an advancing yarn is reciprocated by means of a traversing yarn guide within a traverse stroke, and deposited on the yarn package. To avoid high package edges, the traverse stroke of the traversing yarn guide is variable in its length within the width of the yarn package during the winding operation. The length variations of the traverse stroke occur during the winding cycle by a predetermined stroke modification function, which is determined from a mass distribution of the yarn on a hypothetically wound, ideal yarn package, so that it is possible to produce a predetermined package density of the yarn package.

9 Claims, 6 Drawing Sheets

METHOD AND APPARATUS FOR WINDING A YARN PACKAGE

CROSS REFERENCE TO RELATED APPLICATION

This is a continuation of PCT/EP01/00104, filed Jan. 8, 2001, and designating the U.S.

BACKGROUND OF THE INVENTION

The present invention relates to a method and apparatus of the general type disclosed in EP 0 235 557 and corresponding U.S. Pat. No. 4,913,363, for winding a continuously advancing yarn into a yarn package.

When winding a yarn to a package, the yarn is deposited on the package surface within the width thereof at a substantially constant circumferential speed of the yarn package and at a varying crossing angle. To this end, a traversing yarn guide reciprocates the yarn within a traverse stroke, before the yarn contacts the package surface. To obtain an even mass distribution of the yarn and, thus, a uniform density of the package, in particular in the edge regions thereof, it is known to shorten and lengthen the traverse stroke cyclically during the winding operation. These length variations of the traverse strokes are referred to as a so-called stroke modification. The stroke modification prevents a high edge buildup (saddle formation) of the packages.

In the method disclosed in the above-referenced patent documents, the length of the traverse stroke is varied in accordance with a predetermined stroke modification function. This stroke modification function is defined by the time period, which is needed for reaching again the length of the traverse stroke, which was adjusted before the stroke modification. Thus, the stroke modification function is formed by a plurality of modified strokes, which define a reciprocal movement of the traversing yarn guide at a varied length of the traverse stroke. When traveling through a stroke modification function, the yarn is therefore deposited in many modified strokes on the package surface. The stroke modification function serves to define the distribution of the reversal points of the traversing yarn guide or the yarn on the package surface at the package ends. Thus, the mass distribution of the yarn is directly influenced by predetermining the stroke modification function.

Since in the known method the stroke modification function is based solely on empirical values, there exists the problem that a variation of the mass distribution on the wound yarn package surface is to be changed likewise only on the basis of empirical values.

U.S. Pat. No. 4,771,960 discloses a further method, wherein the stroke modification function effects random length variations of the traverse stroke. To this end, a length is subdivided into a plurality of points between the outermost reversal point and the innermost reversal point, which are each defined by the longest traverse stroke and the shortest traverse stroke. Each of the points represents a reversal point of the traversing yarn guide. In this process, the sequence and the frequency of approaching the individual reversal points are determined by a certain algorithm, which is based on the random principle. Thus, this known method is likewise totally unsuited for producing a predetermined mass distribution of the yarn on the yarn package.

U.S. Pat. Nos. 4,544,113 and 4,767,071 disclose a further method of winding a yarn package, wherein for purposes of varying the length of the traverse stroke, the stroke modification function predetermines an always recurrent, uniform change between a maximum and a minimum traverse stroke. With that, it is possible to produce only a very irregular mass distribution in the end region of the yarn package, which exhibits relatively soft end regions in comparison with the center region.

In the known methods, the length variation of the traverse stroke prevents the buildup of high package edges at the ends of the yarn package. However, the influence on the package density by distributing reversal points in the end regions of the yarn package, as defined by the stroke modification function, is purely random.

It is therefore the object of the invention to further develop a method of the initially described kind for winding a yarn package, as well as an apparatus for carrying out the method in such a manner that after winding the yarn, the yarn package exhibits over the entire package width a uniform package density or a predetermined profile of the package density.

SUMMARY OF THE INVENTION

It is known that the density of the yarn package substantially depends on the mass distribution of the yarn on the package. However, the yarn mass deposited per unit time within a traverse stroke on the circumference of the package is not constant, since at the end of the traverse stroke, the traversing yarn guide is decelerated from a traversing speed, and must again be accelerated to the traversing speed after the reversal. Thus, in the region in which the traversing speed is constant, the yarn mass deposited on the circumference of the yarn package will likewise be constant. Outside this linear range, the yarn mass deposited on the circumference of the yarn package continuously changes up to a maximum in the region of the reversal point.

The method of the present invention establishes a relationship between the stroke modification function and the mass distribution. In this connection, a mass distribution of the yarn is predetermined on a hypothetically wound, ideal yarn package. From the hypothetically wound, ideal yarn package with a predetermined mass distribution of the yarn, the stroke modification function is determined from the distribution of the reversal points on the hypothetically wound, ideal yarn package. This stroke modification function is used to produce the yarn package being wound. The special advantage of the invention lies in that it is possible to wind the end regions of the yarn package with a defined mass distribution of the yarn.

To obtain as small deviations as possible between the predetermined mass distribution of the yarn on the hypothetically wound, ideal yarn package and the wound mass distribution of the yarn on the wound yarn package, it is proposed to use a microprocessor for computing from predetermined winding parameters the mass distribution of the yarn on the hypothetically wound, ideal yarn package. In this instance, one predetermines as winding parameters, for example the yarn speed, the traversing speed, the crossing angle, the yarn denier, and the length of the reversal range. The hypothetically wound, ideal package is ideally wound by computation, wherein the computed mass distribution does not exceed a predetermined desired value. From the computed mass distribution of the yarn on the hypothetically wound, ideal yarn package, the computed distribution of the reversal points of the traversing yarn guide is converted to the stroke modification function. This variant of the method makes it possible to realize a predetermined mass distribution in the case of the wound yarn package without a major deviation.

In a preferred embodiment, the computation of the mass distribution of the yarn on the hypothetically wound, ideal package, is performed in the following steps. First, the yarn mass that is deposited during a traverse stroke is computed from the predetermined winding parameters. Since the yarn mass is proportional to the traversing speed, it is possible to allocate a certain yarn mass to each segment of the traverse stroke. This allocation is related to the package width B. To this end, the traverse stroke is subdivided along the package width into a plurality of mass segments of a constant width. Each mass segment contains the yarn mass deposited in the mass segment. This deposited yarn mass is defined as partial yarn mass. Then, one predetermines a desired value of the mass distribution of the yarn on the hypothetically wound, ideal yarn package that is to be computed, as well as a certain number of traverse strokes. For example, it would be possible to predetermine as desired value of the mass distribution the fact that a constant mass distribution ($F_{desired}$=100%) is present over the entire package width.

The number of traverse strokes is optional, with a higher number leading to a smaller deviation between the computed, hypothetically wound ideal yarn package and the later wound yarn package. Taking into account the number of traverse strokes as well as the desired value of the mass distribution, the previously defined mass segments with the respective partial yarn masses are added up to the mass distribution. The computed mass distribution, which equals the predetermined desired value of the mass distribution, contains a distribution of the mass segments, which serve as a measure for the stroke modification function. In this instance, the absolute number of the mass segments is defined by the number of traverse strokes, since each traverse stroke is formed from a plurality of mass segments.

The stroke modification function, which forms the distribution of the reversal points during the winding cycle, can then be derived from the computed mass distribution by the following steps. From the distribution of the mass segments within the computed mass distribution of the yarn on the hypothetically wound, ideal yarn package, one determines the length variations of the traverse strokes. Since each reversal point or each traverse stroke starts with a mass segment $S_1$, it is possible to derive the length variations of the traverse strokes solely by the distribution of the mass segments $S_1$ relative to the package width. To convert the length variations of the traverse strokes to the stroke modification function, it will be advantageous to include an algorithm of deposit, so that, for example, a certain change is maintained between the variations of the individual traverse strokes.

Since in the range of the traverse stroke, in which the traversing yarn guide operates at a constant traverse speed, the mass distribution is substantially constant, it is further proposed to form the partial yarn mass of one of the mass segments by the ratio of the absolute yarn mass of the mass segment to the absolute yarn mass of a mass segment extending in the center range of the package width. With that, it is possible to compute the mass distribution only for the end regions of the package.

To change the mass distribution of the wound yarn package, the mass distribution of the yarn is predetermined for the hypothetical ideal wound yarn package. The actual value of the mass distribution is then determined by means of a hardness testing device, or manually by a thumb test. A comparison between the predetermined mass distribution and the wound mass distribution makes it possible to find out, whether the wound yarn package has the desired density profile. In the case that deviations exist in certain ranges along the package width, a corrected mass distribution is determined and taken as a basis for the computation of the hypothetically wound, ideal yarn package. From the computation, the stroke modification function is then redefined, so that the newly wound yarn package shows a purposefully changed mass distribution. This variant of the method is especially advantageous for producing certain profiles of the package density in the wound yarn package. It will be advantageous to use this variant of the method in particular at the beginning of a process. In this instance, one could first wind a sample package for purposes of obtaining rapidly an optimized package density from the comparison of actual and desired values. The sample package could have, for example, only a minimum number of yarn layers, so that an optimization is possible after a relatively short winding time.

In a particularly advantageous variant of the method, a controller performs the determination of the stroke modification function and thus the distribution of the reversal points, as well as the control of the traversing yarn guide. The controller is connected to a drive of the traversing yarn guide. This drive influences the traversing motion and the traverse stroke of the traversing yarn guide. Since both the traversing speed and the length of the traverse stroke are determined by the drive of the traversing yarn guide, it is possible to realize the stroke modification function with a high precision. In so doing, the drive of the traversing yarn guide is controlled directly as a function of the stroke modification function in such a manner that the respective length variations of the traversing strokes are carried out.

The method of the present invention is independent of the kind of winding. The kinds of winding include random winding, precision winding, or stepped precision winding. While in the case of random winding, the mean value of the traversing speed remains substantially constant during the winding cycle, the wind ratio (spindle speed to traversing speed) changes constantly during the winding cycle. In the case of precision winding, the wind ratio is kept constant. In the case of a stepped precision winding, however, the wind ratio is changed in steps according to a predetermined program.

Likewise, it is especially advantageous to combine the method of the present invention with the known ribbon breaking method. This permits producing cross-wound packages with a large diameter and a great package density, which ensure a troublefree overhead unwinding of the yarn at high withdrawal speeds of above 1,000 m/min and higher.

The method of the invention may be used both in the case of cylindrical yarn packages with substantially rectangular end faces and for producing biconical yarn packages with oblique end faces.

The apparatus of the present invention for carrying out the method distinguishes itself by a high flexibility in the production of yarn packages. With this apparatus, it is easy to vary the stroke modification functions individually as a function of the predetermined mass distributions. When predetermining the traverse stroke and traversing speed, the controller proceeds each time from an instantaneously predetermined stroke modification function. To this end, the controller comprises a data store for receiving winding parameters and a microprocessor for computing a mass distribution of the yarn on a hypothetically wound, ideal yarn package, and for determining a stroke modification function for varying the length of the traverse strokes.

The flexibility of the apparatus is further increased by the particularly advantageous further development of the invention wherein the traversing yarn guide is driven by means of an electric motor, for example, a stepping motor, or by means of an electric synchro generator. With that, it is possible to couple the traversing speed with the respective length variation of the traverse stroke. A shortening of the traverse stroke can thus occur at a constant traversing speed or with constantly deposited yarn masses per unit time.

The coupling between the traversing yarn guide and the electric motor is preferably designed and constructed as a belt drive. To this end, the electric motor comprises a drive pulley, which drives a belt that extends over at least one belt pulley. The belt mounts the traversing yarn guide, and reciprocates it within the package width.

BRIEF DESCRIPTION OF THE DRAWINGS

In the following, the method of the present invention, as well as the apparatus for carrying out the method of the present invention are described in greater detail with reference to an embodiment illustrated in the attached drawings, in which.

DETAILED DESCRIPTION OF THE PREFERRED EMBODIMENTS

Figure 1:
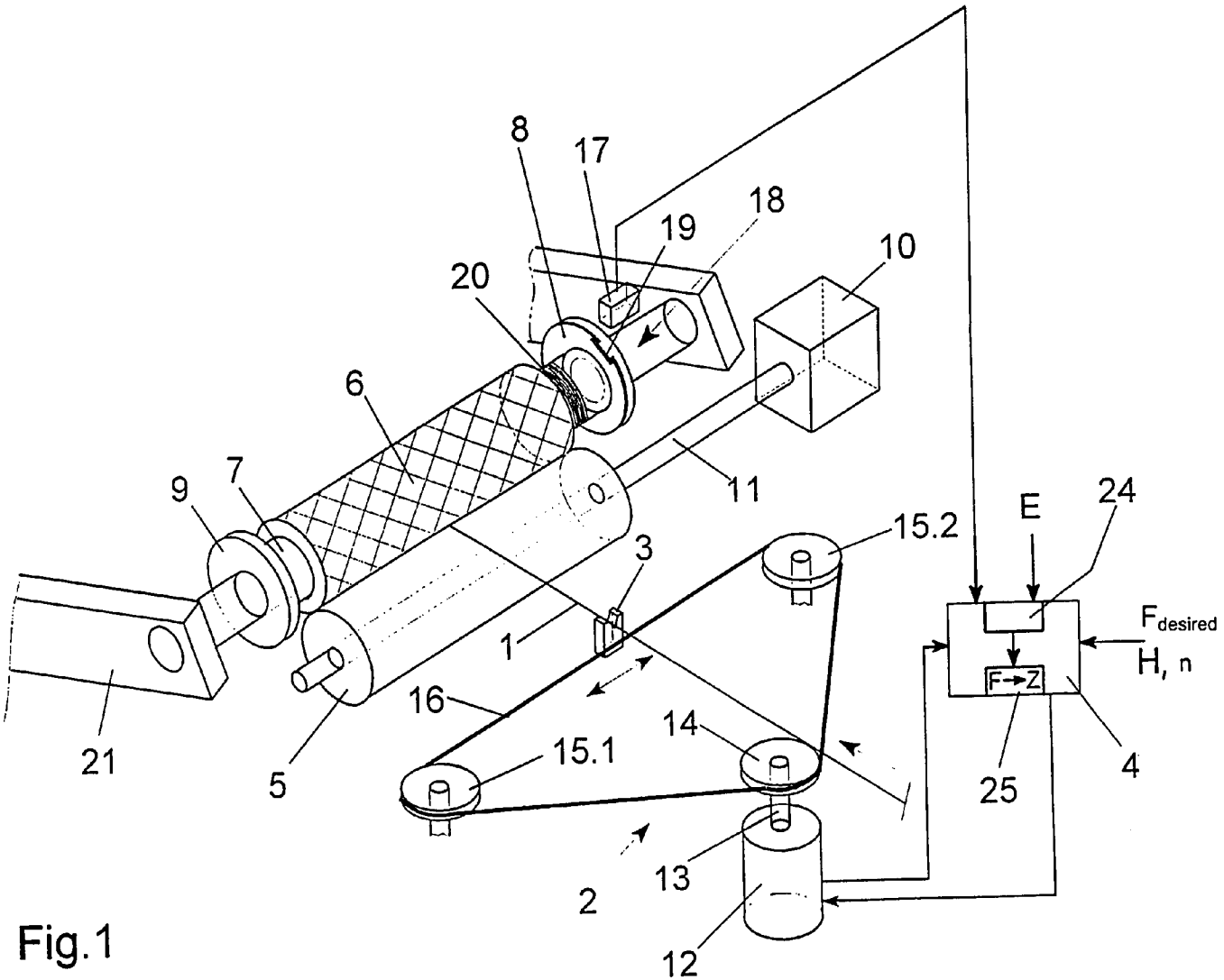
FIG. 1 is a schematic view of an apparatus for carrying out the method of the present invention.

FIG. 1 illustrates an embodiment of an apparatus according to the invention for carrying out the method of the invention, as may be used, for example, in a texturing machine. The free ends of a fork-shaped package holder 21 mount for rotation two opposite centering plates 8 and 9. The package holder 21 is mounted in a machine frame for pivoting about an axle (not shown). Between the centering plates 8 and 9, a tube 7 is clamped for receiving a yarn package 6. A drive roll 5 lies against the surface of tube 7 or yarn package 6. The drive roll 5 is mounted on a drive shaft 11. At its one end, the drive shaft 11 connects to a motor 10. The motor 10 drives drive roll 5 at a substantially constant speed. By frictional engagement, the drive roll 5 drives tube 7 or yarn package 6 at a winding speed, which enables winding a yarn 1 at a substantially constant yarn speed. During the winding cycle, the winding speed remains constant. A yarn traversing device 2 is arranged upstream of drive roll 5. The yarn traversing device 2 is designed and constructed as a so-called belt-type traversing system. In this traversing device, an endless belt 16 mounts a traversing yarn guide 3. The belt 16 extends between two belt pulleys 15.1 and 15.2 parallel to tube 7. In the plane of the belt, a drive pulley 14 is partially looped by the belt and is arranged parallel to the belt pulleys 15.1 and 15.2. The drive pulley 14 is mounted on a drive shaft 13 of an electric motor 12. The electric motor 12 drives the drive pulley 14 for oscillating movement, so that the traversing yarn guide 3 is reciprocated in the region between the two belt pulleys 15.1 and 15.2. The electric motor 12 is controllable via a controller 4. The controller 4 connects to a sensor 17 arranged on package holder 21. This sensor 17 measures the rotational speed of tube 7 and supplies it as a signal to controller 4.

In the present embodiment, the sensor 17 is designed and constructed as a pulse transmitter, which senses a catching groove 19 in centering plate 8. The catching groove 19 forms part of a catching device 18, which engages the yarn 1 at the beginning of the winding cycle, and enables winding the initial layers of the yarn on tube 7. The pulse transmitter 17 supplies per rotation a signal as a function of the always returning catching groove 19. These pulses are converted in controller 4 for evaluating the rotational speed of tube 7.

In the situation shown in FIG. 1, the yarn 1 is wound on tube 7 to the yarn package 6. In this process, the yarn 1 is guided in a guide groove of traversing yarn guide 3. The yarn traversing device 2 is initially positioned so that the yarn guide 3 forms a yarn reserve 20, and then reciprocates the traversing yarn guide 3 within the package width of yarn package 6. In so doing, the electric motor 12, which could be designed and constructed, for example, as a stepping motor, controls the movement and traverse stroke lengths of the traversing yarn guide 3. The increasing package diameter of yarn package 6 is made possible by a pivotal movement of package holder 21. To this end, the package holder 21 comprises biasing means (not shown), which produce on the one hand, between yarn package 6 and drive roll 5, a contact pressure that is required for driving the yarn package, and which enable on the other hand a pivotal movement of package holder 21.

The controller 4 predetermines both the traversing speed of traversing yarn guide 3 and the length of the traverse stroke, which leads to a corresponding control of electric motor 12. For the control, the controller 4 receives a winding parameter E. As winding parameters E, it is possible to predetermine the winding speed, the diameter of the drive, the traversing speed, the variation of the traversing speed within a traverse stroke, and the denier of the yarn being wound. The winding parameters E are deposited in a data store 24 inside controller 4. To determine a stroke modification function Z, the controller 4 comprises a microprocessor 25. Inside the microprocessor 25, a mass distribution F of the yarn on a hypothetically wound, ideal yarn package is computed both from a predetermined mass distribution $F_{desired}$ of the yarn on a hypothetically wound, ideal yarn package, and from a predetermined number of traverse strokes H. From the computation of the mass distribution F, a stroke modification function Z is derived, which causes the length variations of the traverse stroke upon activation of electric motor 12.

To realize an as exact positioning of traversing yarn guide 3 as possible by traverse drive 2, the electric motor 12 connects to controller 4 via a signal line, which is used to supply at a time to controller 4 one angular position of the rotor shaft of electric motor 12. This actual position of the electric motor is included in the control of a desired position of the electric motor, so that both an adjustment and a very precise control of the electric motor are always ensured.

Figure 2:
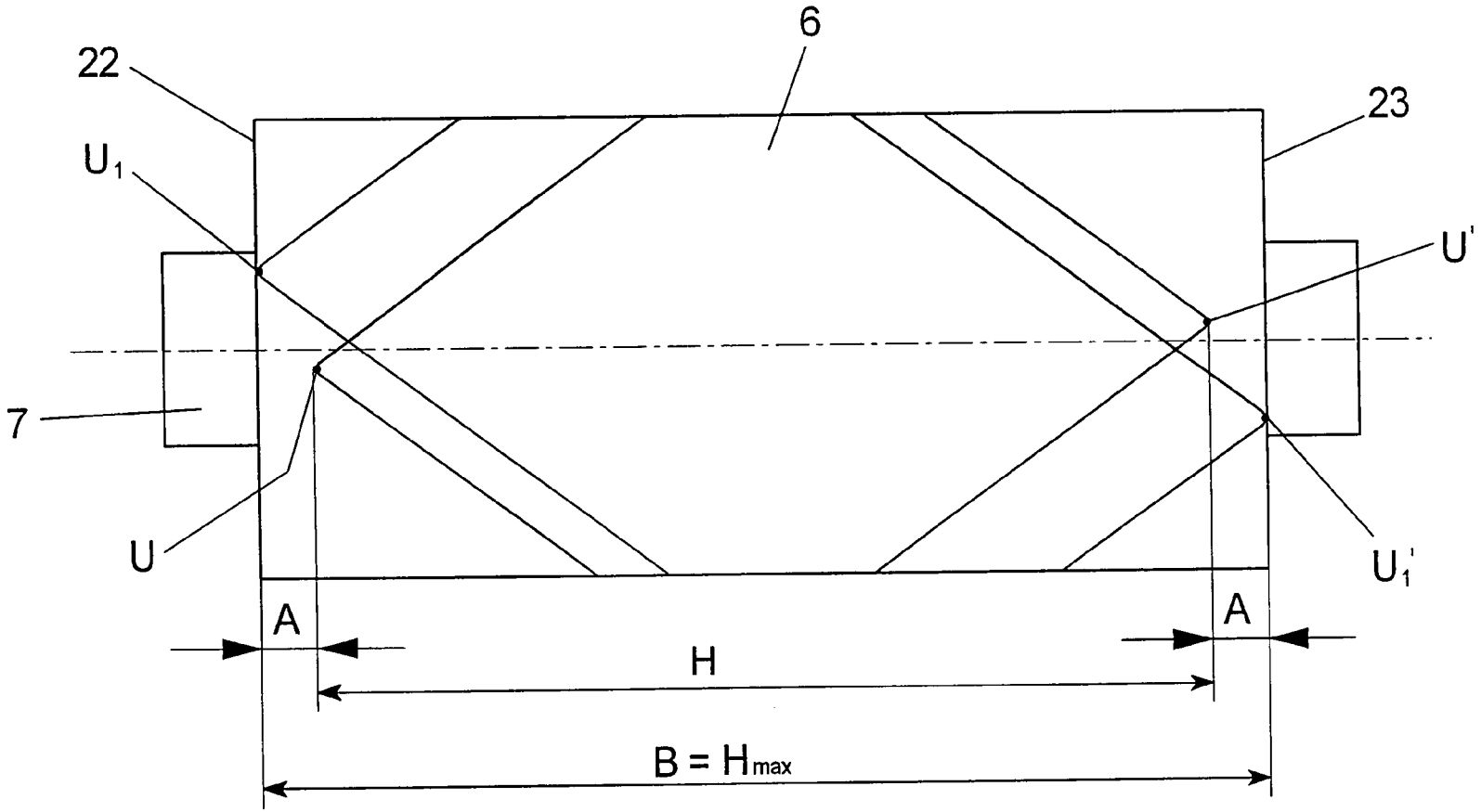
FIG. 2 is a schematic view of a cylindrical yarn package.
Figure 2A:
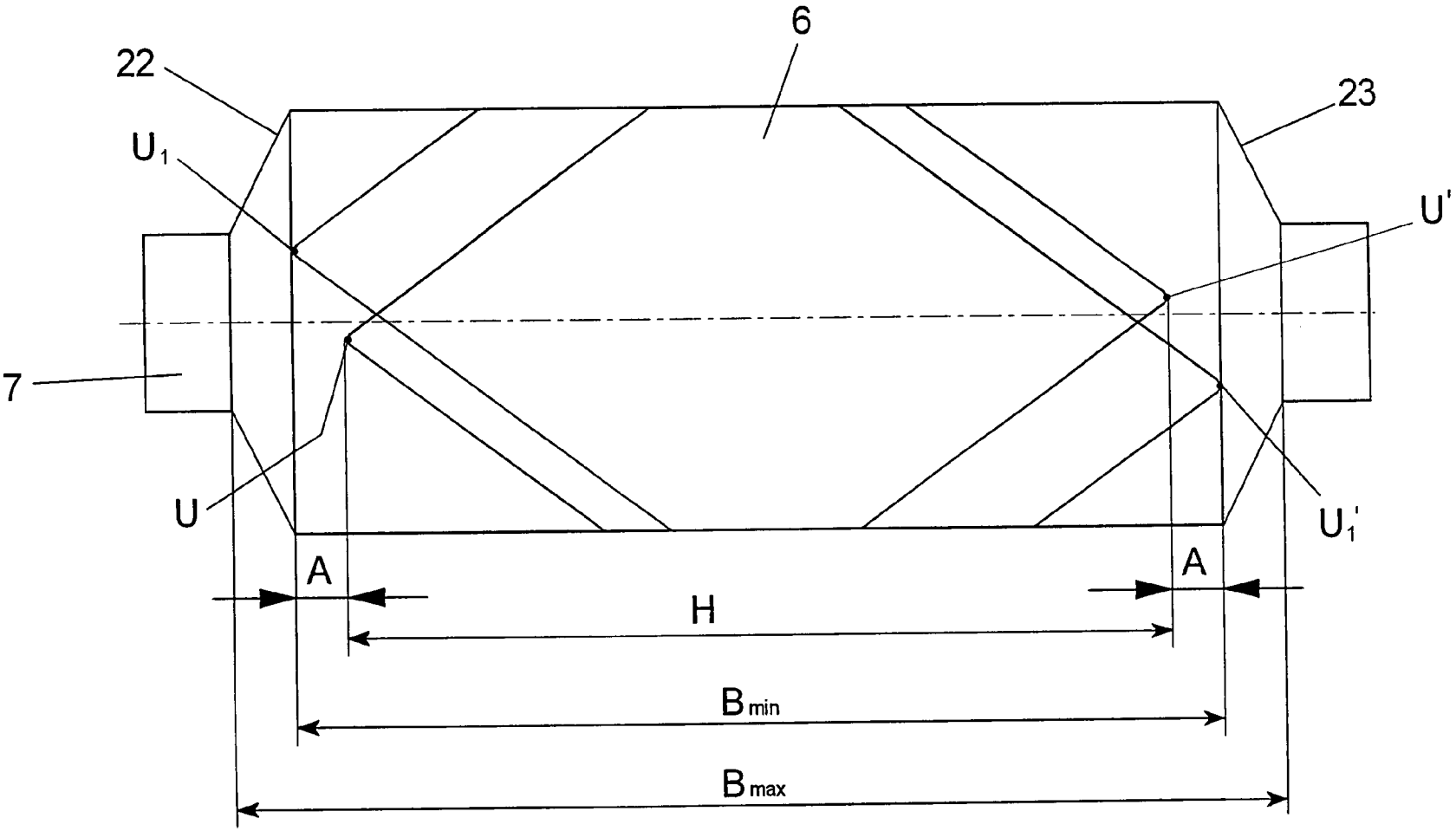
FIG. 2A is a view similar to FIG. 2 and illustrating the invention in association with a biconical package.

To obtain a predetermined mass distribution of the deposited yarn masses, in particular in the end regions of the yarn package, the traverse stroke is varied in its length according to a predetermined stroke modification function Z. FIG. 2 is a schematic view of a cylindrical yarn package. The yarn package 6 is wound on tube 7. The yarn package has a width B. The package width B is formed by a maximum traverse stroke $H_{max}$. The traverse stroke H describes the length, over which the traversing yarn guide is reciprocated. During its reciprocal movement, the yarn is guided in the traversing yarn guide within the traverse stroke, before it contacts the package surface. To this end, the traversing yarn guide is driven at a predetermined traversing speed. At the ends of yarn package 6, the traversing yarn guide is decelerated shortly before its reversal, and again accelerated in the opposite direction. FIG. 2 schematically illustrates this yarn reversal, for example, by some yarn layers on the surface of yarn package 6. The point on the package surface, which marks the change in the direction of the yarn deposit due to the reversal of the traversing yarn guide, is named yarn reversal point U. As a function of the sequence of movements of the traversing yarn guide, the yarn reversal point U may extend at the end of the package over a greater length on the package surface. In this case, the yarn reversal point is to be equated with the reversal point of the yarn deposit. However, it is also possible to define a yarn reversal point hypothetically by extending the yarn lengths that are deposited at the package end.

FIG. 2 shows on the end face 22 of yarn package 6, for example, a yarn reversal point $U_1$. The opposite end face 23 shows a yarn reversal point $U_1'$ that is produced at the same traverse stroke $H_{max}$. The yarn reversal points $U_1$ and $U_1'$ are formed on the outer edge of the yarn package. In this instance, the traversing yarn guide covers the traverse stroke $H_{max}$.

During the winding cycle, a so-called stroke modification is performed by shortening or lengthening the traverse stroke. To begin with, the traverse stroke $H_{max}$ is decreased in accordance with a predetermined stroke modification function to a minimum traverse stroke, and subsequently lengthened to the original value $H_{max}$ of the traverse stroke. FIG. 2 shows by way of example an optional traverse stroke H, which is shortened in comparison with the maximum traverse stroke $H_{max}$ by a length variation A at both package ends. In this instance, the yarn when being reversed, is deposited in reversal point U on the left side of yarn package 6, and in reversal point U' on the right side of yarn package 6.

Figure 3:
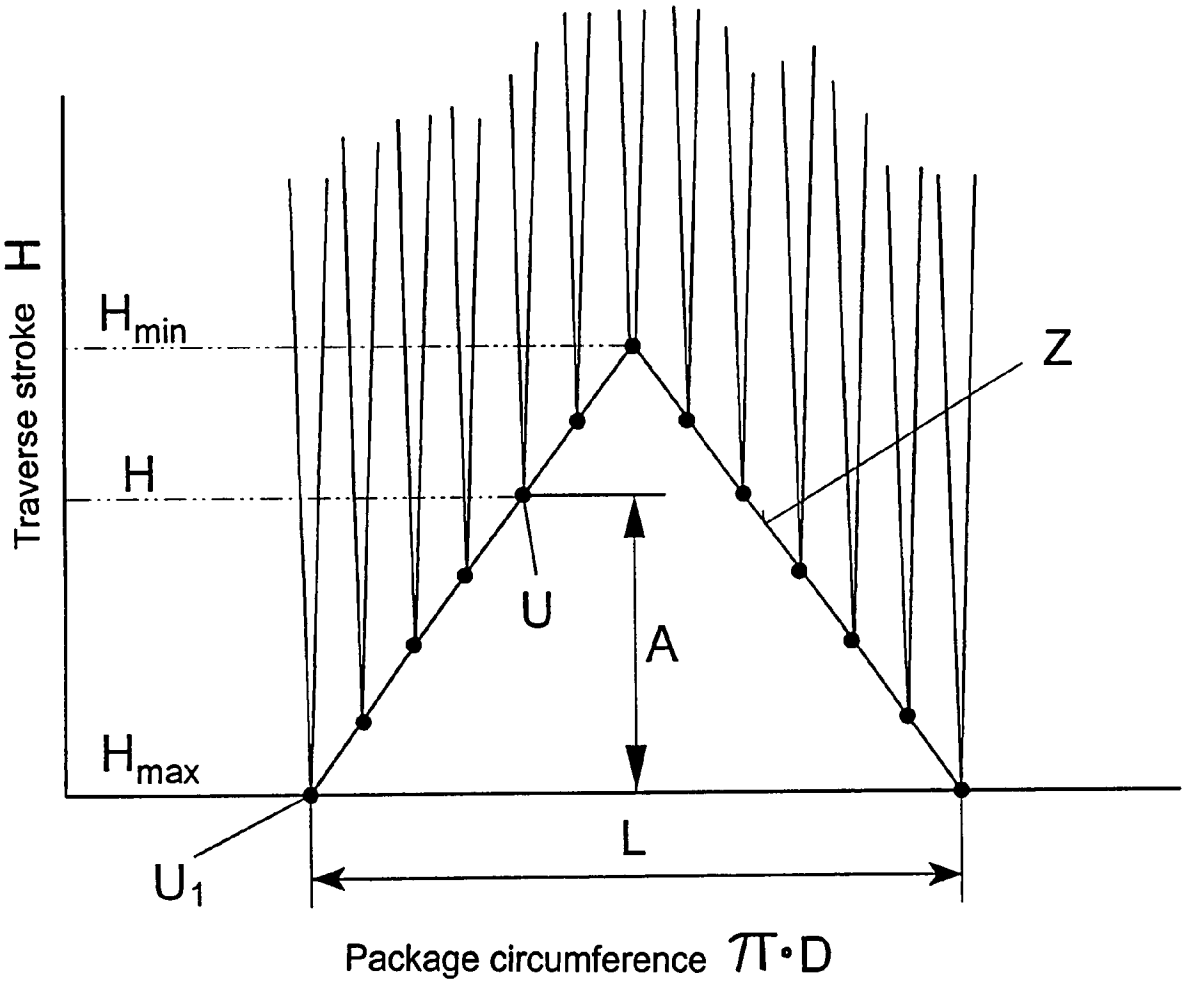
FIG. 3 is a schematic view of a development of a yarn package with length variations of the traverse strokes according to a stroke modification function.

FIG. 3 schematically illustrates in a diagram a stroke modification function Z, for example, for a cycle L. In this diagram, the ordinate marks the traverse stroke H, and the abscissa the package circumference $\pi \cdot D$. The abscissa simultaneously represents one of the end faces of yarn package 6. At the beginning of the stroke modification cycle L, the yarn when being reversed, is deposited in a traverse stroke of the length $H_{max}$ in point $U_1$. The variation of the traverse stroke in subsequent traverse strokes then occurs in accordance with a stroke modification function Z. The stroke modification function Z thus defines the position of the yarn reversal points U of the individual traverse strokes H. The variation of the stroke modification function Z shown in FIG. 3 is exemplary. Within a stroke modification cycle L, the traverse strokes undergo a plurality of length variations A. The cycle L is completed, as soon as the original maximum traverse stroke $H_{max}$ is again reached. While winding the yarn package, a plurality of stroke modification cycles is performed.

Figure 4:
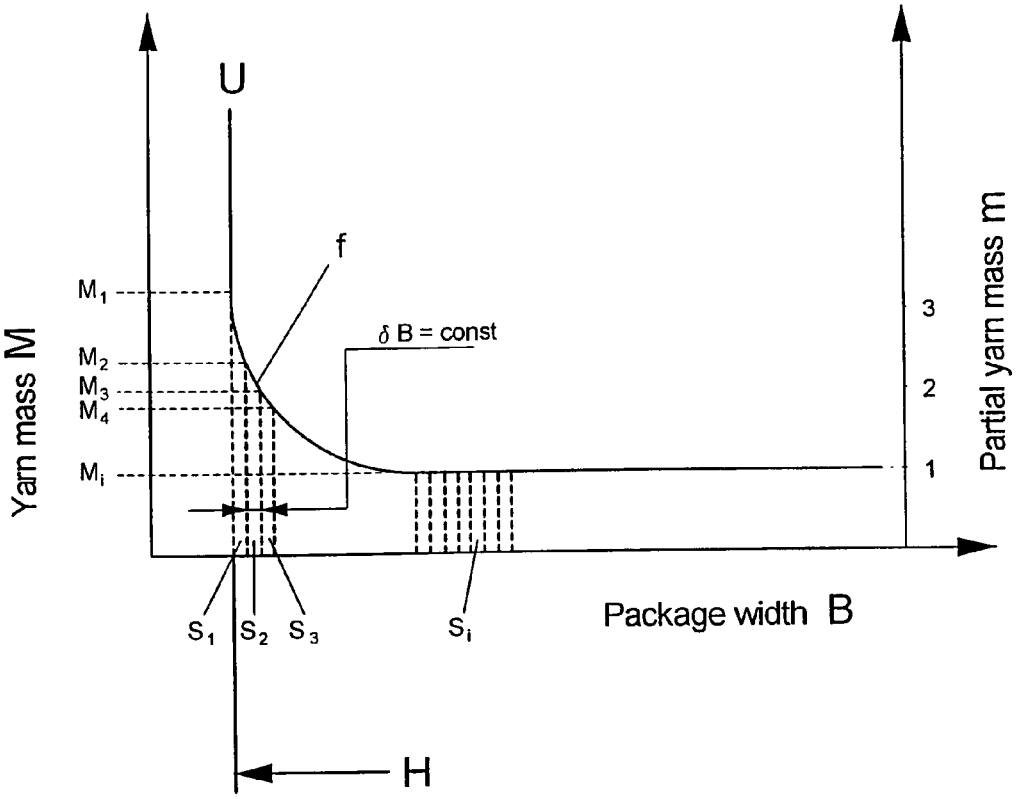
FIG. 4 is a diagram of the distribution of the yarn mass within a traverse stroke.

During each traverse stroke, a yarn length is deposited on the circumference of yarn package 6. FIG. 4 shows in a diagram a yarn mass M, which is deposited during a traverse stroke H. To this end, the yarn mass M is plotted on the ordinate, and the package width B on the abscissa. On the abscissa, the reversal point U is shown, for example, as a straight line. The straight line forms the end of a traverse stroke H. This results in a substantially hyperbolic curve shape f of the yarn mass M over the package width B. Thus, the curve shape f represents the yarn mass deposited along the package within a traverse stroke. As can be noted from the diagram, the deposited yarn mass M varies toward the end of traverse stroke H. In the range, wherein the traversing speed is constant, an unvarying yarn mass is deposited. By decelerating or by accelerating the traversing yarn guide, the deposited yarn mass M continuously increases to a maximum value in the region of the yarn reversal U. To compute a mass distribution F of the yarn on a hypothetically wound, ideal yarn package, the traverse stroke H is divided into a plurality of mass segments S along the package width B. The mass segments receive a constant width $\delta B$. To each thus-formed mass segment S, a yarn mass M is associated, which is deposited within the mass segment S. Thus, the mass segment $S_1$ receives the yarn mass $M_1$, the mass segment $S_2$ the yarn mass $M_2$, etc. up to a mass segment $S_i$ with the yarn mass $M_i$. In this connection, the mass segment $S_i$ lies in a range, wherein the traversing speed is constant. Thus, the associated yarn mass $M_i$ will discontinue to vary, until the opposite end face of the package is reached. On the opposite end face, the division of the mass distribution occurs analogously to the illustration of FIG. 4.

Advantageously, the mass distribution F is computed with standardized and thus dimensionless yarn masses. To this end, a partial yarn mass m of a mass segment is formed by the ratio of the absolute yarn mass M of the aforesaid mass segment to the absolute yarn mass $M_i$ of a mass segment $S_i$ lying in a center range of the package width, wherein the traversing speed is constant. The partial yarn mass in the linear range of the package width is thus m=constant=1. In the reversal regions, the partial yarn mass of the mass segments will assume the values m>1.

Figure 6:
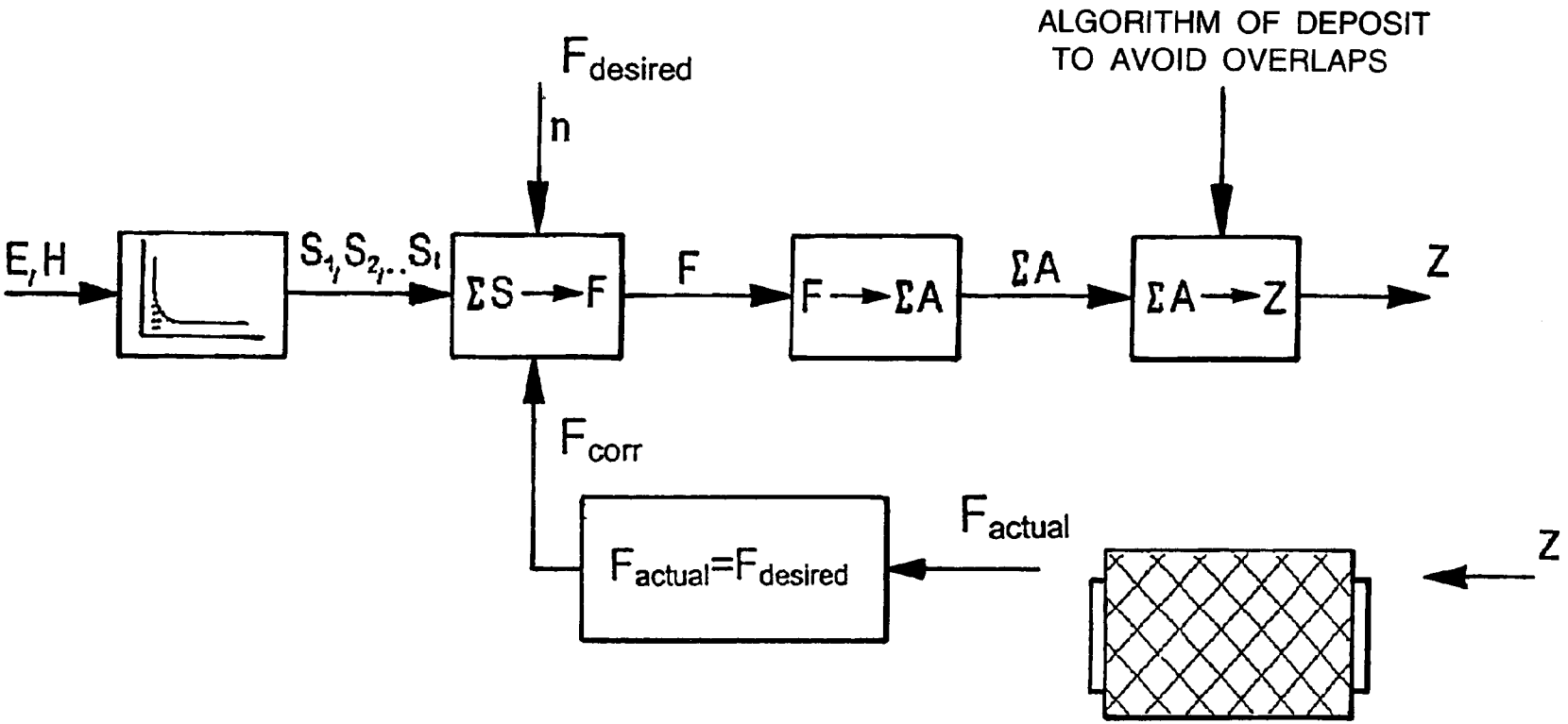
FIG. 6 is a schematic view of a signal plan for determining a stroke modification function Z.

FIG. 6 schematically illustrates with reference to a signal plan the further procedure for determining the stroke modification function Z. After forming the mass segments $S_1$ to $S_i$, the mass distribution F of the yarn on a hypothetically wound, ideal yarn package is computed. To this end, a desired value of the mass distribution $F_{desired}$ of the yarn is predetermined on the hypothetically wound, ideal yarn package. Likewise predetermined is a maximum number n of the traverse strokes that are taken as a basis in the winding of the hypothetical, ideal yarn package. To compute the mass distribution of the hypothetically wound, ideal yarn package, the mass segments $S_1$, $S_2$ to $S_i$ are added up to a multiple corresponding to the number n of the traverse strokes. In so doing, the mass segments are distributed, while maintaining the respective traverse strokes, in such a manner that the computed, entire mass distribution on the package does not exceed the predetermined desired value $F_{desired}$. The computed distribution of the mass segments includes the traverse stroke variations, so that the computed mass distribution F is a measure for the sum of the length variations A of the traverse strokes. Subsequently, the length variations of the traverse strokes as determined from the mass distribution, are determined in the stroke modification function that is required for the stroke modification forming the basis for the winding cycle. In this connection, an algorithm of deposit is taken into account, which includes a basic distribution of the length variations to avoid, for example, overlaps of the yarn.

Since each of the traverse strokes that is taken as a basis in the computation of the mass distribution F, starts with the mass segment $S_1$, it is possible to determine the length variations A of the traverse strokes, for example, in such a manner that the package width B is subdivided into a plurality of small package segments of a constant width. Starting from one end face of the yarn package, the number of mass segments $S_1$ contained in each package segment is determined. This results in a distribution of the mass segments $S_1$ between the maximum traverse stroke $H_{max}$ and a minimum traverse stroke $H_{min}$. The number of the mass segments $S_1$ equals the number of length variations A of the traverse strokes. Thus, it is possible to determine from the distribution of the mass segments $S_1$ directly the stroke modification function Z, while taking into account an algorithm of deposit.

Once the stroke modification function Z is determined, the cycle for winding the yarn starts.

After the yarn package is fully wound, the package density or mass distribution is checked. The wound mass distribution $F_{actual}$ may be determined, for example, manually by a measuring means. The determined mass distribution $F_{actual}$ of the wound yarn package can then be input to the microprocessor. Within the microprocessor, a comparison occurs between the actual mass distribution $F_{actual}$ and the desired value of the mass distribution $F_{desired}$.

Figure 5:
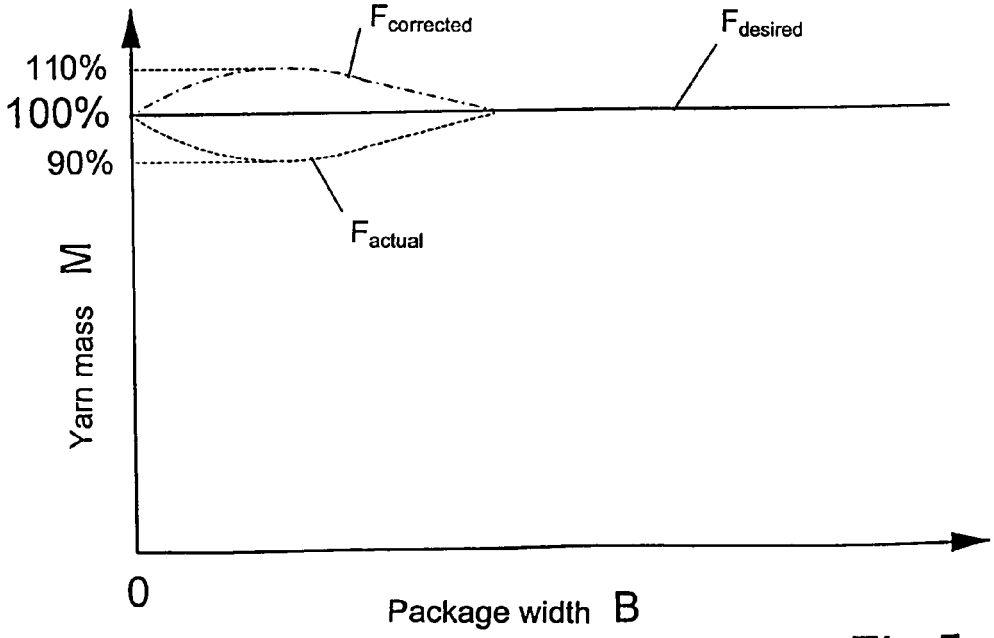
FIG. 5 is a diagram of the distribution of the yarn mass of a yarn package.

FIG. 5 illustrates in a diagram the mass distribution of the yarn mass M on the yarn package. To this end the ordinate marks the yarn mass M and the abscissa the package width B. In this connection, the ordinate represents one end of the package. A value $F_{desired}$ is predetermined as desired value for the mass distribution. According to the diagram, it should be 100% over the entire package width. The diagram also shows the mass distribution $F_{actual}$ that is found in the wound yarn package. In this instance, a deviation between the desired value $F_{desired}$ and the actual value $F_{actual}$ of maximally 10% is found at the ends of the package. To obtain in the wound yarn package the desired value $F_{desired}$, it is possible to generate a correction value $F_{corr}$ of the mass distribution. In so doing, the deviation between the desired value $F_{desired}$ and the actual value $F_{actual}$ is added to the respective package segments of the desired curve. This results in the corrected predetermination of the mass distribution $F_{corr}$. With reference to this corrected mass distribution, the stroke modification function Z is newly computed in accordance with the foregoing description of FIG. 6. The newly computed stroke modification function Z is then taken as a basis for the length variations of the traverse strokes during the ongoing winding cycle.

With that, the method of the present invention represents a possibility of purposefully influencing the distribution of the yarn mass on the yarn package.

The invention claimed is:

1. A method of winding a continuously advancing yarn to form a yarn package, comprising the steps of mounting a bobbin tube at a winding position and rotating the tube about its axis, reciprocating the advancing yarn by means of a traversing yarn guide which reciprocates within a traverse stroke (H) so as to deposit the yarn on the rotating bobbin tube and form the wound package, and varying the length of the traverse stroke of the traversing yarn guide within the width (B) of the package, with the length variations (A) of the traverse stroke occurring in accordance with a predetermined stroke modification function (z) which is determined from a mass distribution (F) of the yarn on a hypothetically wound ideal yarn package, and wherein the mass distribution (F) of the yarn on the hypothetically wound ideal yarn package is computed by the steps of predetermining a desired value of the mass distribution ($F_{desired}$) from predetermined winding parameters (E) and then computing the mass distribution (F) while maintaining the limits of the desired value of the mass distribution ($F_{desired}$).

2. The method as defined in claim 1 wherein the traversing yarn guide is driven for oscillating movement by a controllable drive, which is controlled by a controller, the controller compromising a microprocessor for determining the stroke modification function (Z).

3. The method as defined in claim 2 wherein the controller controls the drive of the traversing yarn guide as a function of the stroke modification function (Z) for carrying out the length variations (A) of the traverse strokes.

4. The method as defined in claim 1, wherein the traversing speed is variable in accordance with a predetermined control program.

5. The method as defined in claim 1, wherein the traverse stroke is variable for producing a biconical package.

6. A method of winding a continuously advancing yarn to form a yarn package, comprising the steps of mounting a bobbin tube at a winding position and rotating the tube about its axis, reciprocating the advancing yarn by means of a traversing yarn guide which reciprocates within a traverse stroke (H) so as to deposit the yarn on the rotating bobbin tube and form the wound package, varying the length of the traverse stroke of the traversing yarn guide within the width (B) of the package, with the length variations (A) of the traverse stroke occurring in accordance with a predetermined stroke modification function (Z) which is determined from a mass distribution (F) of the yarn on a hypothetically wound ideal yarn package, determining an actual mass distribution ($F_{actual}$) of the yarn on the wound yarn package and comparing the actual mass distribution with a predetermined mass distribution ($F_{desired}$) of the yarn on the hypothetically wound, ideal yarn package, and in the case of a deviation of the actual mass distribution ($F_{actual}$) of the yarn on the wound yarn package from the predetermined mass distribution ($F_{desired}$) of the yarn on the hypothetically wound, ideal yarn package, determining a corrected mass distribution ($F_{corr}$) of the yarn on the hypothetically wound, ideal yarn package and determining the stroke modification function (Z) from the corrected mass distribution ($F_{corr}$) of the yarn on the hypothetically wound, ideal yarn package.

7. A method of winding a continuously advancing yarn to form a yarn package, comprising the steps of mounting a bobbin tube at a winding position and rotating the tube about its axis, reciprocating the advancing yarn by means of traversing yarn guide which reciprocates within a traverse stroke (H) so as to deposit the yarn on the rotating bobbin tube and form a wound package, and varying the length of the traverse stroke of the traversing yarn guide within the width (B) of the package, with the length variations (A) of the traverse stroke occurring in accordance with a predetermined stroke modification function (Z) which is determined from a mass distribution (F) of the yarn on a hypothetically wound ideal yarn package, wherein the mass distribution (F) of the yarn on the hypothetically wound ideal yarn package is computed by the steps of predetermining a desired value of the mass distribution ($F_{desired}$) from predetermined winding parameters (E) and then computing the mass distribution (F) while maintaining the limits of the desired value of the mass distribution ($F_{desired}$), and wherein the computation of the mass distribution (F) of the yarn on the hypothetically wound, ideal yarn package includes the steps of:

computing the yarn mass (M) deposited during the traverse stroke (H) from predetermined winding parameters (E);

subdividing the traverse stroke (H) along the package width (B) into a plurality of mass segments (s) with constant widths (δB) and a partial yarn mass (m);

predetermining the desired value ($F_{desired}$) of the mass distribution of the yarn on the hypothetically wound, ideal yarn package, and predetermining a number of traverse strokes ($H_n$); and adding up the mass segments (S) with partial yarn masses (m) to the mass distribution (F) such that the desired value ($F_{desired}$) of the mass distribution is reached, while maintaining the predetermined number of traverse strokes ($H_n$).

8. The method as defined in claim 7, wherein the stroke modification function (Z) is determined by the steps of:

determining the length variations (A) of the traverse strokes from the distribution of the mass segments (S) within the computed mass distribution (F) of the yarn on the hypothetically wound, ideal yarn package; and converting the length variations (A) of the traverse strokes to the stroke modification function (Z), while taking into account an algorithm of deposit.

9. The method as defined in claim 7, wherein the partial yarn mass (m) of one of the mass segments (S) is formed by a ratio of the absolute partial yarn mass (m) of the mass segment (S) to an absolute yarn mass ($M_t$) of a mass segment ($S_t$) extending in a center range of the package width.

* * * * *